US006595622B2

(12) United States Patent
Yamamoto

(10) Patent No.: US 6,595,622 B2
(45) Date of Patent: Jul. 22, 2003

(54) INK JET PRINTHEAD WITH THICK SUBSTRATE PROVIDING REDUCED WARPAGE

(75) Inventor: Ryoichi Yamamoto, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/106,235

(22) Filed: Mar. 27, 2002

(65) Prior Publication Data

US 2002/0191047 A1 Dec. 19, 2002

(30) Foreign Application Priority Data

Mar. 29, 2001 (JP) ..... 2001-095017

(51) Int. Cl.[7] ..... B41J 2/135; B41J 2/05
(52) U.S. Cl. ..... 347/44; 347/63
(58) Field of Search ..... 347/20, 54, 56, 347/63, 65, 68, 70, 4.4, 47

(56) References Cited

U.S. PATENT DOCUMENTS

| | | | | |
|---|---|---|---|---|
| 3,747,120 A | | 7/1973 | Stemme | 347/70 |
| 5,030,317 A | * | 7/1991 | Noguchi | 347/65 |
| 5,666,140 A | | 9/1997 | Mitani et al. | 347/12 |
| 6,164,762 A | * | 12/2000 | Sullivan et al. | 347/56 |
| 6,273,555 B1 | * | 8/2001 | Hess | 347/63 |

FOREIGN PATENT DOCUMENTS

| | | | |
|---|---|---|---|
| JP | 48-9622 | 2/1973 | |
| JP | 54-51837 | 4/1979 | B41J/3/04 |
| JP | 6-71888 | 3/1994 | B41J/2/05 |
| JP | 6-297714 | 10/1994 | B41J/2/05 |
| JP | 7-227967 | 8/1995 | B41J/3/04 |
| JP | 8-20110 | 1/1996 | B41J/2/05 |
| JP | 8-207291 | 8/1996 | B41J/2/16 |
| JP | 10-16242 | 1/1998 | B41J/2/16 |
| JP | 11-245415 | 9/1999 | B41J/2/05 |
| JP | 11-309850 | 9/1999 | B41J/2/015 |

* cited by examiner

*Primary Examiner*—Thinh Nguyen
*Assistant Examiner*—Juanita Stephens
(74) *Attorney, Agent, or Firm*—Whitham, Curtis & Christofferson, P.C.

(57) ABSTRACT

A liquid ejecting apparatus includes a plurality of liquid ejecting devices arranged in one direction on a silicon substrate and a plurality of liquid ejecting nozzles arranged in correspondence with the liquid ejecting devices. At least part of the silicon substrate has a thickness of not less than 700 $\mu$m. An ink jet printer using the liquid ejecting apparatus is also provided. The liquid ejecting apparatus has little warpage, can perform high quality image recording with high production yield and has a long service life. The ink jet printer enables system construction at low cost and high quality image recording.

13 Claims, 5 Drawing Sheets

INK JET PRINTHEAD WITH THICK SUBSTRATE PROVIDING REDUCED WARPAGE

BACKGROUND OF THE INVENTION

1. Field of the Invention

The present invention relates to a liquid ejecting apparatus to be used in, for example, an ink jet recording head of an ink jet printer for recording an image by shooting ink droplets and, in particular, to a liquid ejecting apparatus which is of high accuracy and which is capable of forming a high quality image through high accuracy shooting of ink droplets and achieving an improvement in terms of yield. The present invention also relates to an ink jet printer using such a liquid ejecting apparatus.

2. Description of the Related Art

A thermal ink jet, which rapidly vaporizes a portion of ink through heating by a heater and causes ink droplets to be ejected through nozzles (orifices) by its expansion force or the like, is utilized in various types of printers (See JP 48-9622 A, JP 54-51837 A, etc.).

Apart from this, a printer is known which utilizes an electrostatic ink jet in which an oscillation plate is caused to oscillate by an MEM (micro electronic machine) utilizing static electricity, ejecting ink droplets through nozzles by the energy thereof (See JP 11-309850 A, etc.).

Of those, FIGS. 7A and 7B schematically show an example of a thermal ink jet recording head. FIG. 7A is a plan view of an ink jet recording head as seen from the ink ejecting direction, and FIG. 7B is a sectional view taken along the line IV—IV of FIG. 7A.

As shown in FIG. 7A, in a recording head 150, a large number of nozzles 20 for ejecting ink are arranged in one direction (in FIG. 7B, in a direction perpendicular to the plane of the drawing). In the example shown, the nozzles 20 are arranged in two rows (hereinafter referred to as nozzle rows), thereby increasing the nozzle density.

In this recording head 150, there are directly formed on the surface of a semiconductor substrate such as an Si (silicon) substrate 152 heaters (not shown) corresponding to the individual nozzles 20 and serving as ink ejecting devices, a driving LSI 14 for driving each heater, a partition 15 forming ink flow passages to the nozzles 20, etc. The nozzles (orifices) 20 are formed in an orifice plate 22 laminated/glued to the Si substrate 152 (partition 15).

Further, formed in the silicon substrate 152 of the recording head 150 are an ink groove 16 for supplying ink to the ink flow passages and ink supply holes 18 for supplying ink to the ink groove 16. The ink groove 16 is formed by digging the surface of the silicon substrate 152 and extends in the nozzle row direction. The ink supply holes 18, which make the back side of the Si substrate 152 communicate with the ink groove 16, are formed and arranged at predetermined intervals in the nozzle row direction.

In the recording head 150, ink is supplied to the ink supply holes 18 from the back side of the Si substrate 152 and introduced into the ink groove 16 communicating therewith. From the ink groove 16, the ink flows through the ink passages formed by the partition 15 and leading to the nozzles 20 before it is ejected through the nozzles 20 by being heated by the heaters.

Usually, this recording head 150 is not handled in the form of an Si chip (semiconductor chip) based on the Si substrate 152; it is glued (mounted) to a frame 24 and attached, for example, to a head unit (e.g., a so-called cartridge) of an ink jet printer.

Further, formed in the frame 24 is an ink flow passage 26 for supplying ink from an ink tank of the head unit to the ink supply holes 18 of the recording head 150.

In the recording head 150 (including not only the thermal ink jet shown but also the above-mentioned electrostatic type), in which ink ejecting devices such as heaters are formed in the Si substrate 152, one of the factors leading to a deterioration in product accuracy and yield is warpage (curving) of the recording head 150 (Si substrate 152).

Such warpage naturally leads to positional error of the nozzles 20, i.e., a deterioration in image quality. In extreme cases, the product becomes defective (NG). When the recording head 150 is elongated, this warpage is aggravated and the relative mechanical strength of the head deteriorates, with the result that the above problem becomes more serious.

Various attempts have been made to overcome the problem of such warpage. For example, provision of a reinforcing layer (counter layer) on the back side of the Si substrate 152 and reconsideration of the material of the orifice plate 22 have been proposed. However, no sufficient effect has been achieved yet.

It might be possible to eliminate such warpage of the recording head 150 by mounting to the frame 24 the recording head 150 in a straight state by using a strong adhesive. However, that would make it necessary to keep the recording head 150 in a pressed state until the adhesive cures completely, which is very disadvantageous in terms of productivity and operability. Further, it would be very difficult to straighten the recording head 150 in a stable manner. Moreover, such a method involves application of an excessive force to the recording head 150, so that, in many cases, the method will lead to breakage of the recording head 150 instead of straightening it.

According to this method however, even if the recording head 150 can be straightened well, when the strength is reduced due to secular changes, the recording head 150 may be warped again or be broken because of the residual stress being applied, whereupon the service life of the recording head 150 may be shortened.

SUMMARY OF THE INVENTION

The present invention has been made with a view toward solving the above problem in the prior art. It is an object of the present invention to provide a liquid ejecting apparatus for use in an ink jet recording head or the like in which liquid ejecting devices such as heaters and MEMs are formed on an Si (silicon) substrate prepared by using, for example, a semiconductor manufacturing technique, in which little warpage is involved, which has a long service life and wherein it is possible to obtain a high accuracy product with high yield even in the case where the apparatus has a line structure with a long nozzle row.

Another object of the present invention is to provide an ink jet printer using the liquid ejecting apparatus as an ink jet recording head.

In order to attain the object described above, the first aspect of the present invention provides a liquid ejecting apparatus comprising: a plurality of liquid ejecting devices which are arranged in one direction on a silicon substrate; and a plurality of liquid ejecting nozzles which are arranged in correspondence with the plurality of liquid ejecting devices, wherein at least part of the silicon substrate has a thickness of not less than 700 $\mu$m.

Preferably, the at least part of the silicon substrate which has the thickness of not less than 700 μm is positioned along the one direction in which the plurality of liquid ejecting devices are arranged.

Preferably, the silicon substrate has a portion of which the thickness is continuously not less than 700 μm from end to end in the one direction in which the plurality of liquid ejecting devices are arranged.

Preferably, the plurality of liquid ejecting devices form a length of not less than 10 mm in the one direction in which the plurality of liquid ejecting devices are arranged.

Preferably, a liquid is ejected in a direction substantially perpendicular to a surface of the silicon substrate.

Preferably, the liquid ejecting apparatus is an ink jet recording head.

Preferably, the silicon substrate has a length of not less than 10 mm in the one direction in which the plurality of liquid ejecting devices are arranged.

Preferably, the plurality of liquid ejecting nozzles have a nozzle density of 600 nozzles/inch or more.

Preferably, the silicon substrate has an aspect ratio of 2 to 20 in terms of a ratio of length to width.

In order to attain the object described above, the second aspect of the present invention provides an ink jet printer comprising: an ink jet recording head which includes: a plurality of ink ejecting devices arranged in one direction on a silicon substrate; and a plurality of ink ejecting nozzles arranged in correspondence with the plurality of ink ejecting devices, wherein at least part of the silicon substrate has a thickness of not less than 700 μm.

Preferably, the at least part of the silicon substrate which has the thickness of not less than 700 μm is positioned along the one direction in which the plurality of ink ejecting devices are arranged.

Preferably, the silicon substrate has a portion of which the thickness is continuously not less than 700 μm from end to end in the one direction in which the plurality of ink ejecting devices are arranged.

Preferably, the plurality of ink ejecting devices form a length of not less than 10 mm in the one direction in which the plurality of ink ejecting devices are arranged.

Preferably, ink is ejected in a direction substantially perpendicular to a surface of the silicon substrate.

DESCRIPTION OF THE PREFERRED EMBODIMENTS

Preferred embodiments of a liquid ejecting apparatus according to the present invention and an ink jet printer utilizing this liquid ejecting apparatus will now be described in detail with reference to the accompanying drawings.

Figure 1A:
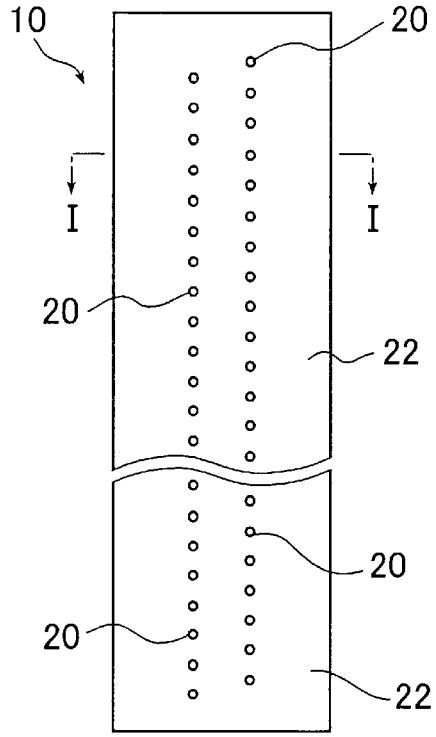
FIG. 1A is a schematic plan view showing an exemplary ink jet recording head to which the liquid ejecting apparatus of the present invention is applied.
Figure 1B:
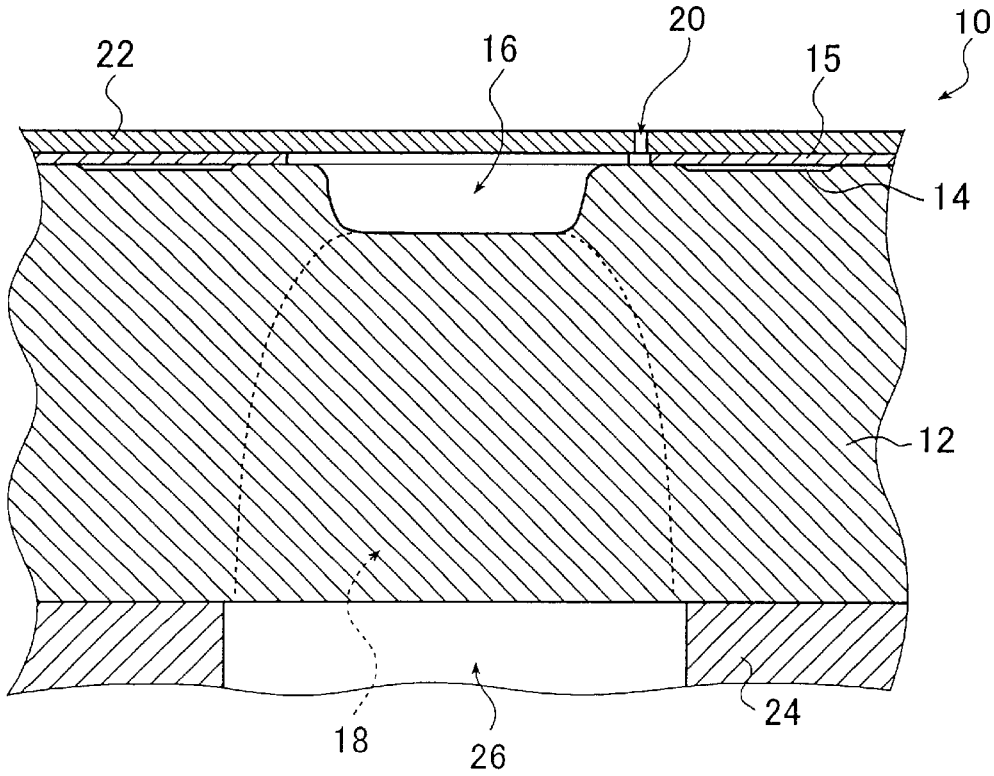
FIG. 1B is a sectional view taken along the line I—I of FIG. 1A.

FIGS. 1A and 1B schematically show an embodiment of the liquid ejecting apparatus according to a first aspect of the present invention which is applied to an ink jet recording head.

The ink jet recording head is not the sole device to which the liquid ejecting apparatus of the present invention is applied. In addition to the ink jet recording head, the liquid ejecting apparatus is applicable with advantage to a processing liquid coating unit or a spray coating unit as long as it has liquid ejecting devices formed in a row in one direction in an Si (silicon) substrate and nozzles arranged in correspondence with the individual liquid ejecting devices.

The ink jet recording head shown in FIGS. 1A and 1B is a so-called thermal ink jet which generates nucleate boiling of ink through heating by a heater and ejects ink by its expansion force and eruption force.

This, however, should not be construed restrictively. The first aspect of the present invention is applicable to various types of liquid ejecting units as long as they are of the type in which liquid ejecting devices such as heaters or MEMs (micro electronic machines) are formed in an Si substrate. For example, the first embodiment is preferably applicable to an electrostatic ink jet recording head which has an ink chamber provided with nozzles and in which one wall of the ink chamber is formed as an oscillation plate oscillated by an MEM using static electricity, ink being ejected through nozzles and introduced into the ink chamber by the oscillation energy.

The ink jet recording head to which the present invention is applied may be a small ink jet recording head for a carriage type printer in which scanning is performed with a carriage in a direction perpendicular to the nozzle row in combination with intermittent conveyance of an ink jet recording sheet, an image receiving sheet or a recording medium (hereinafter collectively referred to as recording sheet), or a so-called line head in which the nozzle row extends over the entire area of one side of a recording sheet (or a region extending beyond that).

Further, while the example shown is a so-called top shooter type (face ink jet) ink jet recording head which ejects ink in a direction substantially perpendicular to the surface of the semiconductor substrate such as the Si (silicon) substrate, this should not be construed restrictively. The present invention is also applicable, for example, to a side shooter type (edge ink jet) ink jet recording head which ejects ink in a direction substantially parallel to the Si substrate surface.

As described below, it is desirable for the ink jet recording head of the present invention to be of an elongated type which has a long nozzle row and to be of the top shooter type.

FIGS. 1A and 1B schematically show an exemplary ink jet recording head according to the first aspect of the present invention. FIG. 1A is a plan view of the ink jet recording head as seen from the ink ejecting (shooting) direction, and FIG. 1B is a sectional view taken along the line I—I of FIG. 1A.

The ink jet recording head 10 (hereinafter referred to as the recording head 10) shown in FIGS. 1A and 1B is mostly the same as the recording head 150 shown in FIGS. 7A and 7B, so that the components common to them are indicated by the same reference numerals, and the following description will be focused on where they differ.

Like the recording head 150 shown in FIGS. 7A and 7B, the recording head 10 has a large number of ink ejecting nozzles 20 arranged in one direction (a direction perpendicular to the plane of FIG. 1B), and the nozzles 20 are arranged in two rows (hereinafter referred to as nozzle rows), thereby increasing the nozzle density.

In the recording head 10 of the present invention, the number of nozzle rows is not restricted to two. It may also be one or three or more. Further, there are no particular restrictions regarding the colors of inks ejected from the nozzle rows and the combination thereof.

Also in the recording head 10 shown, a heater driving LSI 14 is formed in an Si substrate 12 (Si wafer (see reference numeral 50 in FIG. 3)), and there is formed a partition 15 (described in detail below) covering the driving LSI 14 to form ink flow passages leading to the nozzles.

Further, formed in the Si substrate 12 are an ink groove 16 for supplying ink to the ink flow passages formed by the partition 15, etc., and ink supply holes 18 for supplying ink to the ink groove 16. The ink groove 16 is formed by digging the surface of the Si substrate 12 in correspondence with the entire nozzle row region. Similarly, the ink supply holes 18 extend through the Si substrate 12 from the back side so as to communicate with the ink groove 16 and are formed at predetermined intervals.

Further, on the Si substrate 12 (partition 15), an orifice plate 22 with the nozzles 20 formed therein is laminated and glued thereto by an adhesive.

The orifice plate 22 and the partition 15 may be formed of well-known materials such as polyimide.

As in the above-described example, this recording head 10 is attached/fixed (mounted) to a predetermined position of a frame 24, and attached, for example, to a head unit (e.g., a so-called cartridge) of an ink jet printer.

In the recording head 10, ink supplied from an ink tank attached to the head unit is supplied to the ink supply holes 18 from the back side of the Si substrate 12 by way of an ink flow passage 26 of the frame 24, and introduced to the ink groove 16 formed in the surface of the Si substrate 12.

Figure 2A:
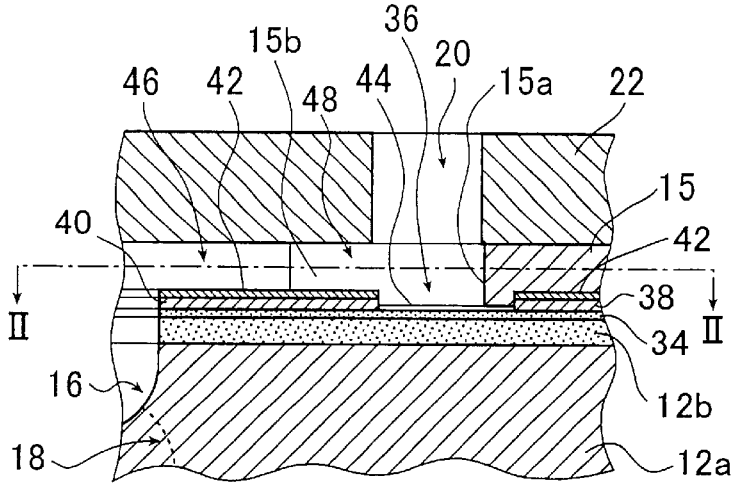
FIG. 2A is a partial enlarged view of FIG. 1A.
Figure 2B:
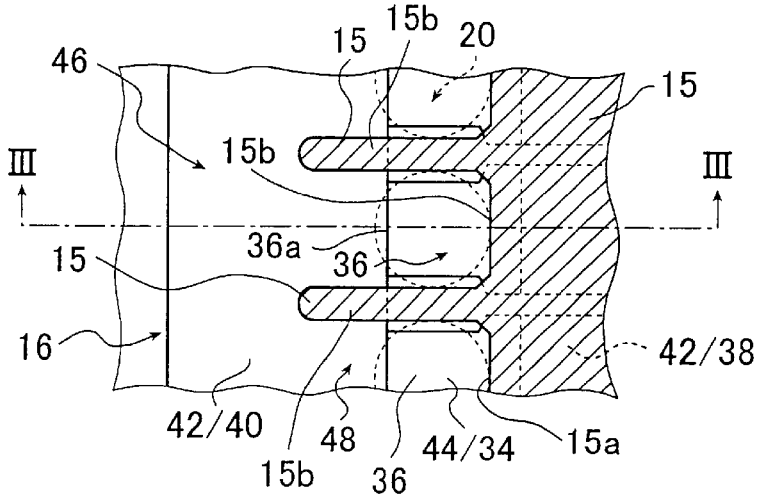
FIG. 2B is a schematic sectional view taken along the line II—II of FIG. 2A.

FIG. 2A is an enlarged view of a portion around the nozzle 20 of FIG. 1B, and FIG. 2B is a sectional view taken along the line II—II of FIG. 2A. That is, the sectional view taken along the line I—I of FIG. 1A is the same as the sectional view taken along the line III—III of FIG. 2B.

As shown in FIGS. 2A and 2B, the Si substrate 12 comprises an Si layer 12*a* and a silicon oxide ($SiO_2$) layer 12*b* formed simultaneously with the driving integrated circuit (IC or LSI; hereinafter collectively referred to as LSI) 14 in the Si substrate 12 by the LSI formation process. The $SiO_2$ layer 12*b* behaves as a heat insulating layer.

On the $SiO_2$ layer 12*b*, there is formed a thin film resistor 34. Further, in the portion on the thin film resistor 34 other than the region corresponding to the nozzles 20 (heat generating portion 36*a* of each heater 36), there are formed on the driving LSI 14 side with respect to the nozzles 20 individual conductor thin films 38 respectively corresponding to the nozzles 20. Further, on the opposite side thereof, there is formed a common conductor thin film 40 common to all the nozzles 20. The thin film resistor 34, the individual conductor thin films 38, and the common conductor thin film 40 form the heaters 36 respectively corresponding to the nozzles 20.

Further, in the example shown, there is preferably formed a gold plating layer 42 covering both conductor thin films.

In the example shown, the thin film resistor 34 is formed, for example, of a ternary alloy: tantalum (Ta)—Si—oxygen, and the individual conductor thin films 38 and the common conductor thin film 40 are formed of nickel (Ni).

Further, in the region of the thin film resistor 34 not covered with the conductor thin films, that is, in the region corresponding to the nozzles 20 (heat generating portion 36*a* of each heater 36), an insulating film 44 is formed by heating and oxidizing the thin film resistor 34 (the above-mentioned ternary alloy) in an oxidizing atmosphere. The insulating film 44 has a superior strength and exhibits corrosion resistance to ink, thus serving as a protective layer.

The gold plating layer 42 prevents the surface of the bonding pad of the driving LSI 14 from being oxidized during the oxidation of the ternary alloy, which is effected through heating.

Apart from the one mentioned above, the thin film resistor may consist of hafnium (Hf)—boron (B) or Ta—aluminum (Al), or a conductor thin film of Al. Further, it is also possible to provide a protective layer for preventing cavitation, etc.

As shown in FIGS. 1A, 1B, 2A, and 2B, the partition 15 forming the ink passages for guiding ink from the ink groove 16 to the nozzles 20 has a region (front wall portion) 15*a* covering the entire area on the opposite side of the ink groove 16 with respect to the nozzles 20 and extending to the vicinity of the nozzles 20, and lateral wall portions 15*b* extending through the intervals of the nozzles 20 and protruding from the above-mentioned region toward the ink groove 16 somewhat beyond the nozzles 20.

Thus, as described above, the ink supplied to the ink groove 16 reaches from a common ink flow passage 46 on the gold plating layer 42 where no partition 15 is formed to individual ink flow passages 48 separated for each nozzle by the partition 15 (the lateral wall portions 15*b* thereof), and, by nucleate boiling caused through heating by each heater 36 driven by the driving LSI 14, ejected through the corresponding nozzle 20 (in front of the plane of the drawing in FIGS. 1A and 2B, and upwardly in FIGS. 1B and 2A).

The recording head 10, constructed as described above, is described in detail in JP 6-71888 A, JP 6-297714 A, JP 7-227967 A, JP 8-20110 A, JP 8-207291 A, JP 10-16242 A, etc.

In the recording head 10 of the present invention, at least a part of the Si substrate 12, preferably a portion along the direction in which the heaters 36 (nozzles 20) are arranged has a thickness of not less than 700 $\mu$m.

As described above, in the example shown, the Si substrate 12 comprises the Si layer 12*a* and the $SiO_2$ layer 12*b*. That is, in the present invention, the sum total of the thickness of the Si layer 12*a* (e.g., Si wafer 50 (see FIG. 3)) and the thickness of the compound layer ($SiO_2$ layer 12*b*) whose main component is Si and which has been formed through reaction of the surface of the Si layer 12*a* is preferably not less than 700 $\mu$m.

As stated above, one of the factors leading to a deterioration in the accuracy of the (ink jet) recording head and a reduction in production yield is warpage of the recording head.

To prevent this warpage, various measures have been taken including the formation of a counter layer without achieving any sufficient effect. It might be possible to effect straightening at the time of mounting to the frame 24. However, as stated above, it is rather difficult to effect straightening in a stable manner, and it may even lead to breakage.

It may be assumed that this warpage is attributable to inner residual stress generated during the production of the recording head 10.

As is apparent from the above construction, the recording head 10 in which heaters, etc. are formed in the Si substrate 12 can be produced by utilizing a semiconductor manufacturing technique using photolithography, thin film formation technique or the like.

Figure 3:
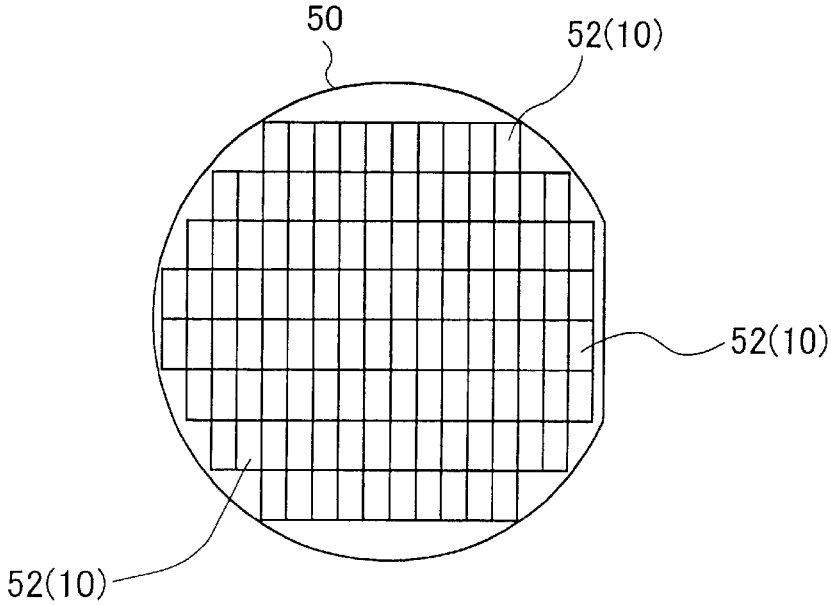
FIG. 3 is a conceptual view of an Si wafer for illustrating an example of a method of producing the ink jet recording head shown in FIGS. 1A and 1B.

For example, first, as schematically shown in FIG. 3, driving LSIs 14, partitions 15, ink supply grooves 16, ink supply holes 18, etc. are formed in a large number of Si chips 52 of the Si wafer 50 in correspondence with the individual recording heads 10. After the partitions 15 are laminated/formed, an orifice plate 22 with no nozzles 20 is laminated/glued to the surface of the Si wafer 50, and nozzles 20 are formed in correspondence with the recording heads 10 (Si chips 52) to complete a large number of recording heads 10 on the Si wafer 50. Thereafter, the Si wafer 50 is cut into the individual recording heads 10 by dicing, and each recording head 10 thus obtained (in the form of the Si chip 52) is mounted on the frame 24 as described above.

Usually, the orifice plate 22 is glued to the partition 15 by using an adhesive. The partition 15 is formed of polyimide or the like by photolithography. Thus, there remains inside the recording head 10 residual stress due to these operations. Further, since the recording head 10 has the ink groove 16 formed by digging the Si substrate 12 (Si wafer 50), the ink supply holes 18 extending through the Si substrate 12, etc., its mechanical strength has been substantially deteriorated.

Figure 7A:
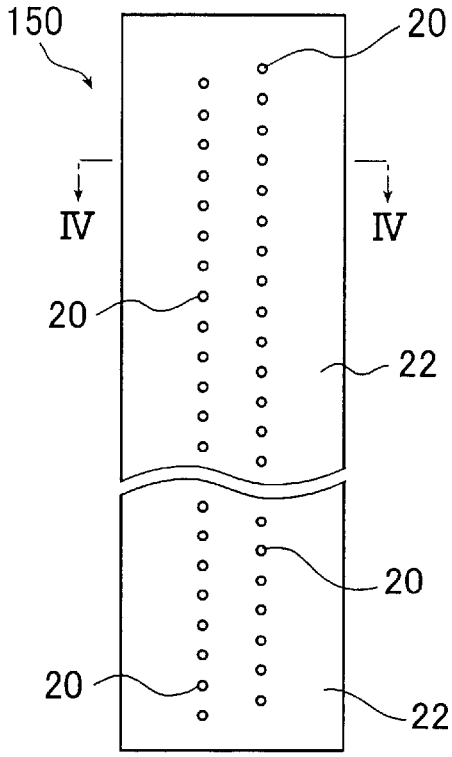
FIG. 7A PRIOR ART
FIG. 7A is a schematic plan view showing an example of a conventional ink jet recording head.
Figure 7B:
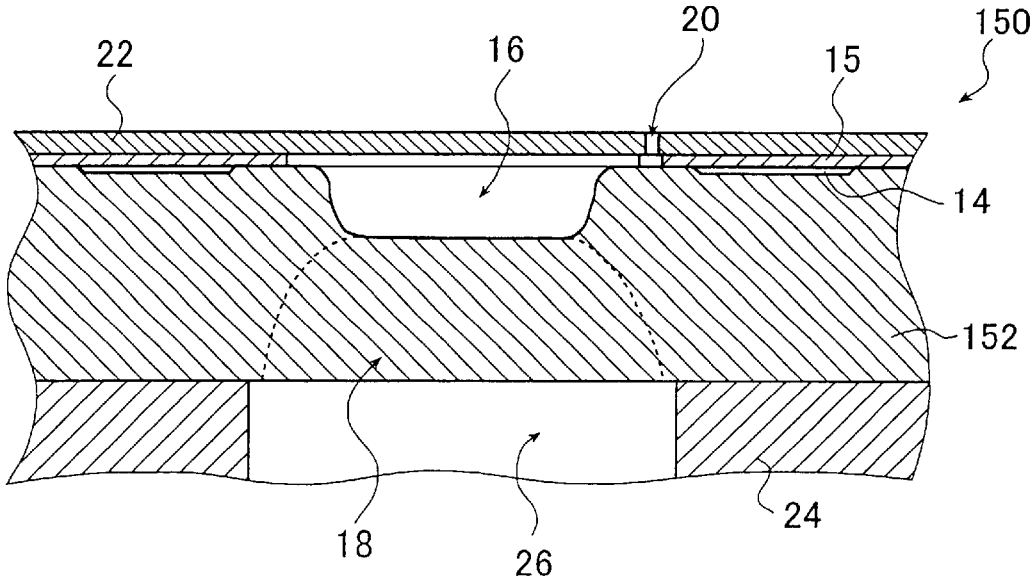
FIG. 7B PRIOR ART
FIG. 7B is a sectional view taken along the line IV—IV of FIG. 7A.

Thus, in the conventional recording head 150 shown in FIGS. 7A and 7B, although there is no problem before cutting the Si wafer into the individual recording heads 150 (before dicing), each recording head 150 (Si substrate 152) is warped and curved upon this cutting due to the inner residual stress and deterioration in mechanical strength.

In particular, the longer the recording head 150, the more aggravated is the warpage, the mechanical strength deteriorating therewith. Thus, the above problem is more serious.

The present inventors have found out that to prevent the warpage due to the inner stress, it is most effective to make the Si substrate 12 thick, and that, in particular, by making the thickness 700 $\mu$m or more, it is possible to substantially mitigate the warpage in a stable manner.

At present, in an (ink jet) recording head using an Si substrate, the standard thickness of the Si substrate is approximately 200 to 250 $\mu$m. Even with a relatively thick substrate, its thickness is approximately 400 to 600 $\mu$m. As disclosed in JP 11-245415 A, etc., there is a technique for grinding the back side of the Si wafer to make it thinner, taking into account the operability in cutting and mounting. However, in this technique, the rigidity of the Si substrate yields to the inner stress, causing warpage in the recording head (Si substrate).

In contrast, in the recording head 10 of the present invention, in which at least a part of the Si substrate 12, preferably a portion along the direction in which the heaters 36 (nozzles 20) are arranged has a thickness of not less than 700 $\mu$m, there is very little warpage due to the inner stress; even in the case of an elongated recording head such as a line head, it is possible to realize a high quality image recording with high accuracy while achieving high production yield in a stable manner.

In the present invention, at least a part of the Si substrate 12 needs to have a thickness of not less than 700 $\mu$m, but it is desirable for the Si substrate 12 to have a portion having a thickness of not less than 700 $\mu$m continuously from end to end in the nozzle row direction.

This construction makes it possible to realize a recording head 10 of higher accuracy and higher yield with further reduction in warpage.

In the present invention, it is desirable for the thickness of the silicon substrate 12 to be not less than 800 $\mu$m and, more preferably, not less than 1000 $\mu$m.

The thickness of the Si substrate 12 can be controlled by appropriately selecting the thickness of the Si wafer 50 serving as the base material.

In terms of warpage, the thicker the Si substrate 12 is, the more it is preferred. The thickness has no particular upper limit, but the Si substrate 12 has preferably a thickness of not more than 2 mm in terms of cost. If the thickness of the Si substrate 12 exceeds 2 mm, it takes too much time to form the ink supply passage including the ink groove 16 and the ink supply holes 18, in particular the ink supply holes 18, which may cause a cost problem.

Normally, such warpage in the recording head 10 is generated in the nozzle row direction, which is the longitudinal direction of the recording head. The larger the size in the nozzle row direction (hereinafter referred to the "length") of the head, the larger the positional deviation between the central portion and the ends of the nozzles 20 when warpage is generated, that is, the more serious the deterioration in product accuracy. Thus, the longer the recording head 10 (liquid ejecting apparatus) of the present invention, the better the effect obtained.

In the present invention, there is no particular limitation regarding the length of the recording head 10. The length is preferably 10 mm or more and, more preferably, 20 mm or more.

The length of the recording head 10 has no particular upper limit. However, the length is preferably not more than 300 mm in terms of the cost and the yield on the manufacturing technology.

The example shown in the figure is a top shooter type recording head 10 which ejects ink droplets in a direction substantially perpendicular to the Si substrate surface. However, as stated above, a side shooter type (ink jet) recording head, which ejects ink droplets in a direction substantially parallel to the Si substrate surface, is well known, and the present invention is applicable to both types.

In a side shooter type recording head, any warpage generated in the recording head appears as an error in ink impact position in the direction perpendicular to the nozzle row at the center and the ends of the nozzles 20. Usually, this error due to warpage of the recording head rarely leads to any visual problem. If it does, it is possible to correct it through signal processing (e.g., adjustment of ejection timing with respect to pixel positions).

Figure 4:
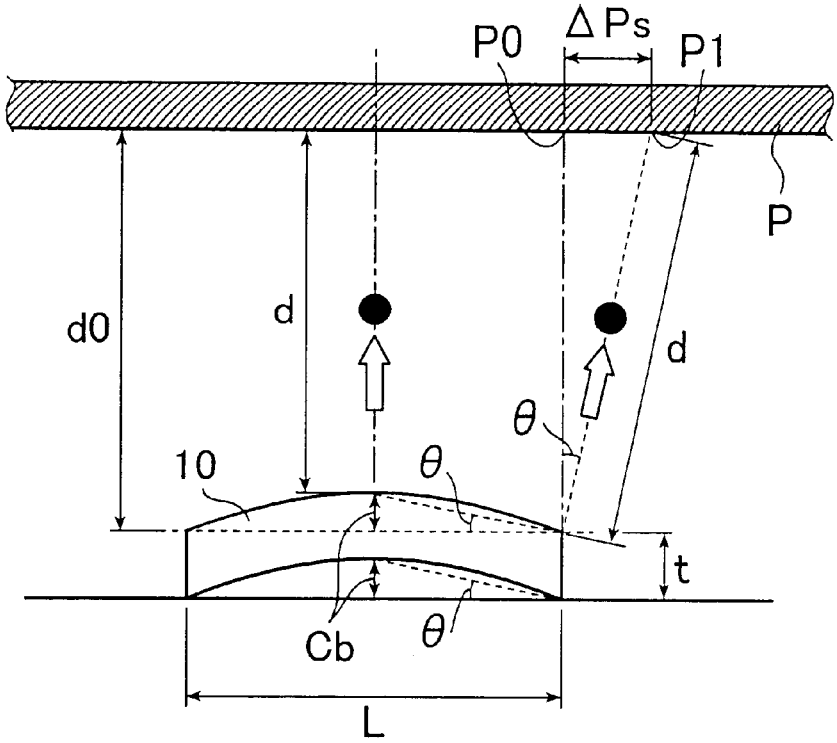
FIG. 4 is a conceptual view for illustrating the relation between the allowable chip warpage amount of an Si substrate, the chip length and the distance from the recording head to a recording sheet in the ink jet recording head to which the liquid ejecting apparatus of the present invention is applied.

In contrast, in the top shooter type recording head 10 of the illustrated case, any warpage generated in the recording head 10 appears, as shown in FIG. 4, as an error in the distance between the nozzles 20 and the recording sheet P (i.e., ink droplet shooting distance) and an error in ink impact position in the nozzle row direction. These errors attributable to the warpage of the recording head 10 lead to a deterioration in image quality such as feathering or streaky unevenness that is very visible and are very hard to correct through signal processing. The longer the recording head 10, the more serious the deterioration in image quality.

FIG. 4 is a conceptual view for illustrating the relation between the allowable chip warpage amount, the chip length and the head-sheet distance in the top shooter type recording head 10. The chip warpage amount Cb refers to a warpage amount of the recording head 10 in the direction in which the nozzles 20 (heaters 36) are arranged (nozzle row direction), and more specifically a warpage amount of the Si substrate 12 in the nozzle row direction. The chip length L refers to a length of the recording head 10 (that is, the Si substrate 12) in the nozzle row direction. Further, the head-sheet distance d refers to a distance between the nozzles 20 of the recording head 10 and a recording sheet P used.

The deviation in the ink impact position ΔPs in FIG. 4 refers to a distance between the position P0 at which ink droplets from the non-warped recording head 10 are to impact the sheet, and the position P1 at which ink droplets from the warped recording head 10 actually impacted the sheet. This deviation is not more than about 1 μm and more specifically not more than the range of about 1.0 to about 1.2 μm. That is, the deviation is preferably not more than 1.2 μm and more preferably not more than 1.0 μm.

When an image is recorded on a recording sheet P for example with the recording head 10 having two rows of staggered nozzles of which the linear density is 900 npi (nozzles/inch), the image on the recording sheet P has an ink droplet density of 1800 droplets/inch. The pitch of the ink droplets on the image is thus 14 μm. If the deviation in the impact position ΔPs is about one-tenth the pitch, that is, about 1.4 μm, a finally obtained image is adversely affected.

Assuming in FIG. 4 that the direction in which ink droplets are shot is perpendicular to the nozzle row direction irrespective of whether the recording head 10 is warped or not, in the case of the nozzle 20 which is located at an end of the recording head 10 and in which the deviation in the impact position ΔPs is the largest, the angle θ formed between the ink droplet shooting direction in the warped recording head 10 and the ink droplet shooting direction in the non-warped recording head 10 can be the same as the angle θ formed between the line connecting the central nozzle 20 to the end nozzle 20 in the warped recording head 10 and that in the non-warped recording head 10. The latter angle determines the warpage amount. Therefore, when the chip warpage amount, the chip length, the head-sheet distance in the non-warped recording head 10, and the deviation in the impact position are Cb, L, d0 and ΔPs, respectively, the following equations are given:

$$\tan\theta = Cb/(2/L) = \Delta Ps/d0$$

$$Cb = \Delta Ps \times (2/L)/d0$$

Therefore, when the allowable deviation in the impact position and the allowable chip warpage amount are ΔPs0 and Cb0, respectively, the allowable chip warpage amount Cb0 can be represented by the following expression:

$$Cb0 \leqq \Delta Ps0 \times (2/L)/d0$$

In the recording head 10 of the present invention, at least a part of the Si chip 52 or Si substrate 12 of the recording head 10, preferably a portion along the nozzle row direction can be given a thickness of not less than 700 μm to reduce the allowable chip warpage amount Cb0 to 1.2 μm or less. Warpage of the Si substrate 12 can be thus substantially prevented to the extent that the warpage amount falls within the allowable range of not more than 1.2 μm.

That is, the present invention which can realize a recording head 10 with very little warpage, helps to achieve a greater effect in a top shooter type recording head. Thus, it is desirable for the present invention to be applied to a top shooter type recording head 10 and, in particular, as described above to a top shooter type recording head 10 having a length not less than 10 mm.

The deterioration in image quality brought by the deviation in the impact position due to warpage of the recording head 10 is the more serious, the higher the nozzle density. Therefore, the recording head of the present invention which can realize the very little warpage by giving at least a part of the Si chip 52 (Si substrate 12) the thickness of not less than 700 μm can obtain the greater effect, in particular, in the case of a nozzle density of not less than 600 nozzles/inch in which the warpage leads to a very serious deterioration in image quality.

Thus, it is desirable for the recording head 10 of the present invention to have a nozzle density of 600 nozzles/inch or more and, more preferably, a nozzle density of 900 nozzles/inch or more.

The nozzle density of the recording head 10 has no particular upper limit. However, the nozzle density is preferably not more than 2400 nozzles/inch in terms of the cost and the yield of the manufacturing technology.

While there is no particular limitation regarding aspect ratio (the ratio of length to width (dimension in a direction perpendicular to length direction)), it is desirable for the ratio of length/width to be 2 to 20 and, more preferably, 5 to 10.

This recording head 10 can be produced basically in the same manner as various types of (ink jet) recording heads in which ink ejecting devices such as heaters 36 are formed in the Si substrate 12.

The thickness of the Si substrate 12 can be made 700 μm or more by appropriately selecting the thickness of the Si wafer 50 serving as the base material as described above. In this case, the operability in the perforation of the ink supply passage including the ink groove 16 and the ink supply holes 18, in particular the ink supply holes 18 deteriorates. However, this can be sufficiently compensated for through appropriate selection of the processing method and by processing from both sides of the Si wafer 50. The ink supply passage can be perforated with high efficiency by processing from the both sides of the Si wafer 50 (Si substrate 12) (the side on which the heaters 36 are formed and its opposite side) using the etching technique, sandblasting technique or combination thereof.

Figure 5:
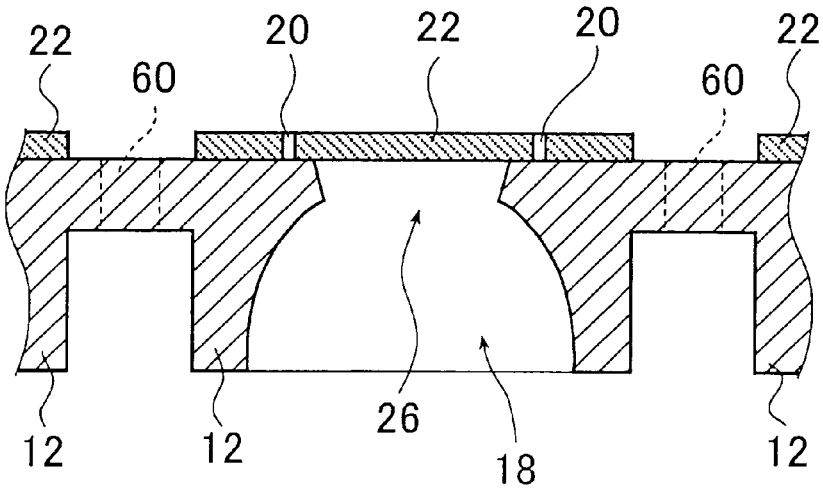
FIG. 5 is a schematic sectional view showing another example of the ink jet recording head to which the liquid ejecting apparatus of the present invention is applied.

In the present invention, the Si substrate 12 is given a thickness of 700 μm or more by selecting the thickness of the Si wafer 50 serving as the base material. Therefore, when the ink supply passage is perforated as mentioned above, more specifically when the ink supply holes 18 are formed, it is preferable to process a scribe line 60 simultaneously as shown in FIG. 5 to improve the dicing workability so that the individual recording heads 10 can be separated from each other after the orifice plate 22 in which the nozzles 20 are perforated is glued to the Si substrate 12.

Since the heaters 36 are formed in the Si substrate 12 having a thickness of 700 μm or more, the present invention may use the Si wafer 50 previously processed so that the thickness of the heater-forming portion (corresponding to nozzle-forming portion) is different from that of the scribe line-forming portion in the Si substrate 12, in other words, the Si wafer 50 in which the heater-forming portion (nozzle-forming portion) is as thick as not less than 700 μm whereas the scribe line-forming portion is as thin as 200 to 600 μm, for example.

Figure 6A:
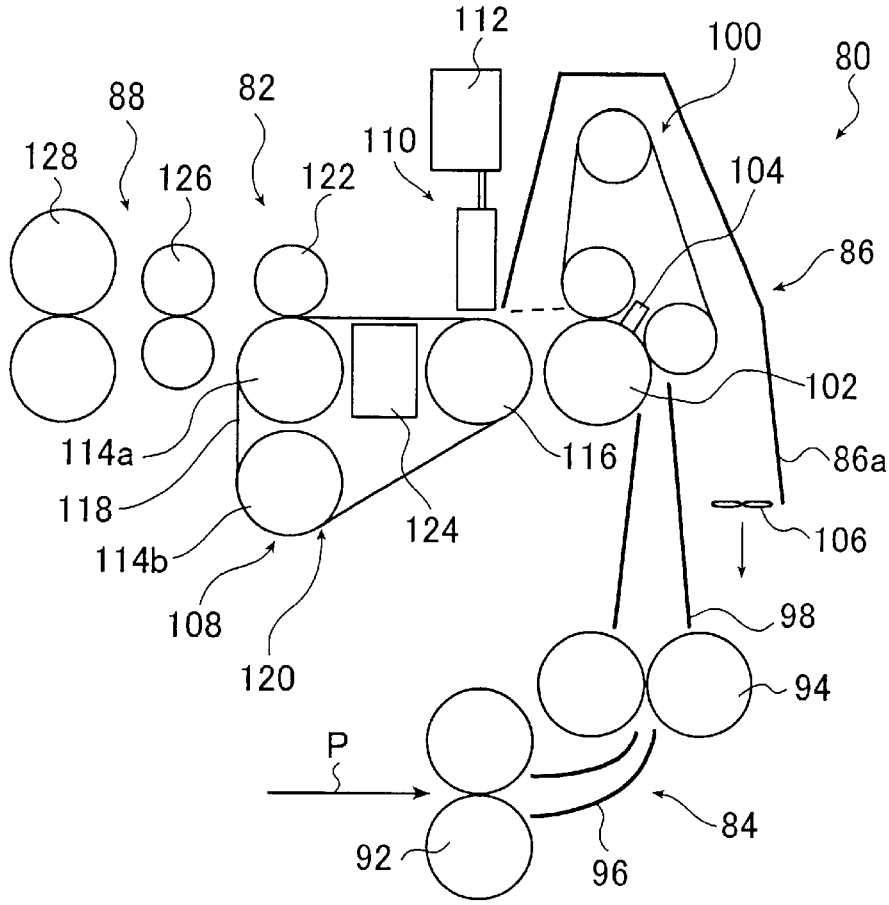
FIGS. 6A and 6B are conceptual views showing an example of the ink jet printer of the present invention.
Figure 6B:
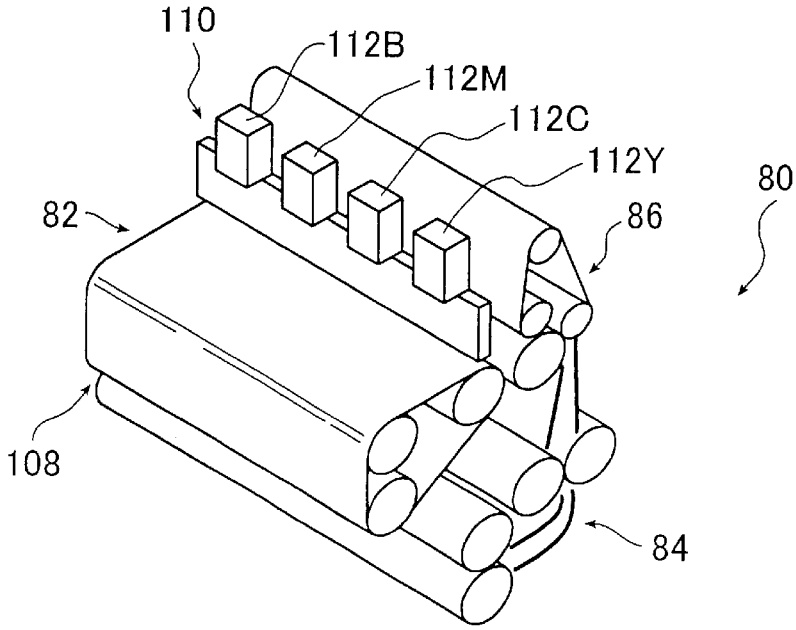

FIGS. 6A and 6B schematically show an embodiment of the ink jet printer according to the second aspect of the present invention using the recording head 10 according to the first aspect of the present invention. FIG. 6A is a conceptual drawing showing the construction of this ink jet printer, and FIG. 6B is a conceptual perspective view of this ink jet printer.

In the ink jet printer 80 (hereinafter referred to as the printer 80) shown in FIGS. 6A and 6B, a line head having a nozzle row extending beyond one side of a recording sheet P is used as the recording head 10. Basically, this printer 80 is a well-known ink jet printer except that it uses the recording head 10.

The printer 80 shown in FIGS. 6A and 6B comprises a recording section 82 using the recording head 10, a sheet feeding section 84, a pre-heating section 86, and a discharging section 88 (not shown in FIG. 6B). Apart from these, the printer 80 may include a maintenance unit having a wiper, a cap, etc. for cleaning and protecting the recording head 10.

The sheet feeding section 84 has conveyance roller pairs 92 and 94, and guides 96 and 98, and the recording sheet P is conveyed horizontally and then upwardly by the sheet feeding section 84 and supplied to the pre-heating section 86.

The pre-heating section 86 has a conveyor 100 consisting of three rollers and an endless belt, a press contact roller 102 pressed against the endless belt from outside the conveyor 100, a heater 104 pressed against the press contact roller 102 (endless belt) from inside the conveyor 100, and a ventilating fan 106 for ventilating the interior of the pre-heating section 86 (the interior of the housing 86*a*).

Before an image is recorded by the ink jet, the pre-heating section 86 heats the recording sheet P to thereby accelerate the drying of the ink on the recording sheet P. The recording sheet P conveyed from the sheet feeding section 84 is heated by the heater 104 while being held and conveyed by the conveyor 100 and the press contact roller 102 before being conveyed to the recording section 82.

The recording section 82 comprises a head unit 110 using the recording head 10 and a recording/conveyance portion 108.

In the head unit 110, the recording head 10 is mounted, and ink tanks 112 (112Y, 112C, 112M, and 112B) are provided. In the recording head 10, nozzle rows are arranged so as to extend in a direction perpendicular to the plane of FIG. 6A.

The recording/conveyance portion 108 comprises a conveyor 120 consisting of rollers 114*a* and 114*b*, an attraction roller 116, and a porous endless belt 118, a nip roller 122 (not shown in FIG. 6B) pressed against the porous endless belt 118, and an attraction box 124 arranged inside the conveyor 120.

The recording head 10 is arranged with its nozzles 20 directed toward the attraction roller 116 side. The recording/conveyance portion 108 conveys the recording sheet P continuously at a predetermined speed in a direction perpendicular to the nozzle rows of the recording head 10. Thus, scanning is performed on the entire surface of the recording sheet P supplied from the pre-heating portion 86 with the nozzle rows of the recording head 10 consisting of a line head, whereby an image is recorded.

The conveyor 120 is formed by the porous endless belt 118, and further includes the attraction roller 116 and the attraction box 124. Thus, the recording sheet P is conveyed in a state in which it is attracted by the porous endless belt 118 and maintained correctly at a predetermined position with respect to the recording head 10.

The recording sheet P on which the image has been recorded is supplied to the discharging section 88, and conveyed by a conveyance roller pair 126 and a discharging roller pair 128 before being discharged, for example, onto a discharge tray (not shown).

The ink jet printer of the present invention is not restricted to the embodiment described above; various well-known ink jet printers can be used. For example, it may be a carriage type printer in which the recording sheet is intermittently conveyed and in which a carriage causes the recording head (head unit) to perform scanning. Further, it may be equipped with a feeder or the like for automatically supplying the recording sheet.

The embodiments of the liquid ejecting apparatus and ink jet printer of the present invention described in detail above should not be construed restrictively. It goes without saying that various improvements and modifications are possible without departing from the scope of the present invention.

EXAMPLES

The present invention will now be described in more detail with reference to specific examples.

Example 1

The recording heads 10 as shown in FIGS. 1A, 1B, 2A and 2B were prepared by the following procedures.

In this example, there were prepared from a single Si wafer 50, 700 recording heads 10 each having a nozzle density of 600 nozzles/inch, 192 nozzles 20 in a row, a length of 10 mm, and a width of 2 mm.

Using an Si wafer 50 having a thickness of 825 μm (tolerance: ±15 μm) and utilizing a semiconductor device manufacturing technique, driving LSIs 14 corresponding to the individual recording heads 10 were formed. Further, as a result of this process, an $SiO_2$ layer 12*b* was formed on the upper surface of the Si layer 12*a* (Si wafer 50).

Then, a ternary alloy Ta—Si—O layer was formed by sputtering, and further, an Ni layer was formed, and there was prepared by photoetching heaters 36 comprising a thin film resistor 34, an individual conductor thin film 38, and a common conductor thin film 40.

Further, after forming a gold plating layer 42 on the Ni layer, the ternary alloy was oxidized by heating it in an oxidizing atmosphere to thereby form an insulating film 44.

After the formation of the insulating film 44, polyimide is applied by spin coating or the like, and the partition 15 was formed by photo dry etching.

Then, a photoresist mask was formed by photolithography, and the ink supply holes 18 and the ink grooves 16 were formed by wet etching.

Thereafter, an adhesive was applied to one surface of the orifice plate 22, and it was laminated and glued to the surface of the Si wafer. Further, the nozzles 20 were formed in correspondence with the recording heads 10 by photo dry etching.

After the formation of the nozzles 20, the Si wafer 50 was cut with a dicer used in an ordinary semiconductor process to thereby obtain the individual recording heads 10.

Examples 2 through 5, Comparative Examples 1 through 3

Recording heads 10 were prepared in completely the same manner as in Example 1 except that the Si substrates used were as follows: an Si substrate having a thickness of 700 μm (Example 2); an Si substrate having a thickness of 625 μm (Comparative Example 1); an Si substrate having a thickness of 400 μm (Comparative Example 2); an Si substrate having a thickness of 1500 μm (Example 3); an Si substrate having a thickness of 1250 μm (Example 4); an Si substrate having a thickness of 1000 μm (Example 5); and an Si substrate having a thickness of 625 μm (Comparative Example 3).

In Examples 3 through 5 and Comparative Example 3, the length of the recording head was 25.4 mm. The thickness of each Si substrate was such that its tolerance was ±15 μm.

Warpage amount [μm] was measured for each recording head 10 thus prepared, and the yield [%] of the recording heads 10 prepared from a single Si wafer 50 was calculated.

Warpage amount measurement was performed on each recording head 10 prepared from an Si wafer 50 as described below, and the average value was calculated as the warpage amount. Each recording head was placed on a flat surface with its convex portion directed upwards, and the distance between the most raised portion and the flat surface was measured by a laser interferometer (for measurement values of less than 10 μm) and a non-contact three-dimensional measuring device (for measurement values of not less that 10 μm).

The results are shown in the following table.

| | Wafer thickness | Head length | Warpage amount | Warpage evaluation | Advantage rate | Advantage rate evaluation |
|---|---|---|---|---|---|---|
| Example 1 | 825 | 10 | 3 | ○ | 80 | ○ |
| Example 2 | 700 | 10 | 5 | ○ | 65 | ○ |
| Comparative Example 1 | 625 | 10 | 7 | X | 50 | X |
| Comparative Example 2 | 400 | 10 | 15 | X | 30 | X |
| Example 3 | 1500 | 25.4 | 7 | ○ | 90 | ○ |
| Example 4 | 1250 | 25.4 | 10 | ○ | 90 | ○ |
| Example 5 | 1000 | 25.4 | 15 | ○ | 90 | ○ |
| Comparative Example 3 | 625 | 25.4 | 40 | X | 30 | X |

In the above results, the warpage evaluation was made as follows: the threshold value was 5 μm for a recording head 10 having a length of 10 mm, and 25 μm for a recording head 10 having a length of 25.4 mm. A specimen with a warpage amount of not more than the threshold value was evaluated as "602", and a specimen with a warpage amount exceeding the threshold value was evaluated as "X". Regarding the advantage rate evaluation, a specimen with an advantage rate exceeding 50% was evaluated as "602", and a specimen with an advantage rate of not more than 50% was evaluated as "X".

Assuming here that the allowable deviation in the impact position ΔPs0 and the distance d0 between the nozzles 20 of the recording head 10 and the recording sheet P are for example 1.2 μm and 2 mm, respectively, the allowable warpage amount Cb0 calculated from the expression mentioned above is 6 μm when the length L is 10 mm or 15.2 μm when the length L is 25.4 mm. Therefore, Examples 1 through 5 provide recording heads which have little deterioration in the image quality and which enable high quality image recording.

The effect of the present invention is obvious from the above results.

As described in detail above, according to the first aspect of the present invention, there is provided a liquid ejecting apparatus of the type in which ink ejecting devices such as heaters are formed in a semiconductor substrate such as an Si substrate, the device involving very little warpage and having high accuracy. When applied, for example, to an ink jet recording head, the liquid ejecting apparatus is capable of performing high quality image recording, provides high production yield, and has a long service life.

According to the second aspect of the present invention, there is provided an ink jet printer which uses the liquid ejecting apparatus according to the first aspect of the present invention as the ink jet recording head, which enables system construction at low cost and high quality image recording.

What is claimed is:

1. A liquid ejecting apparatus comprising:

a plurality of liquid ejecting devices which are arranged in one direction on a silicon substrate; and a plurality of liquid ejecting nozzles which are arranged in correspondence with said plurality of liquid ejecting devices, wherein at least part of said silicon substrate has a thickness of not less than 700 μm, and wherein said silicon substrate has an aspect ratio of 2 to 20 in terms of a ration of length to width.

2. The liquid ejecting apparatus according to claim 1, wherein said at least part of said silicon substrate which has the thickness of not less than 700 μm is positioned along said one direction in which said plurality of liquid ejecting devices are arranged.

3. The liquid ejecting apparatus according to claim 1, wherein said silicon substrate has a portion of which the thickness is continuously not less than 700 μm from end to end in said one direction in which said plurality of liquid ejecting devices are arranged.

4. The liquid ejecting apparatus according to claim 1, wherein said plurality of liquid ejecting devices form a length of not less than 10 mm in said one direction in which said plurality of liquid ejecting devices are arranged.

5. The liquid ejecting apparatus according to claim 1, wherein a liquid is ejected in a direction substantially perpendicular to a surface of said silicon substrate.

6. The liquid ejecting apparatus according to claim 1, wherein said liquid ejecting apparatus is an ink jet recording head.

7. The liquid ejecting apparatus according to claim 1, wherein said silicon substrate has a length of not less than 10 mm in said one direction in which said plurality of liquid ejecting devices are arranged.

8. The liquid ejecting apparatus according to claim 1, wherein said plurality of liquid ejecting nozzles have a nozzle density of 600 nozzles/inch or more.

9. An ink jet printer comprising:

an ink jet recording head which includes:

a plurality of ink ejecting devices arranged in one direction on a silicon substrate; and a plurality of ink ejecting nozzles arranged in correspondence with said plurality of ink ejecting devices, wherein at least part of said silicon substrate has a thickness not less than 700 $\mu$m, and wherein said silicon substrate has an aspect ratio of 2 to 20 in terms of a ratio of length to width.

10. The ink jet printer according to claim 9, wherein said at least part of said silicon substrate which has the thickness of not less than 700 $\mu$m is positioned along said one direction in which said plurality of ink ejecting devices are arranged.

11. The ink jet printer according to claim 9, wherein said silicon substrate has a portion of which the thickness is continuously not less than 700 $\mu$m from end to end in said one direction in which said plurality of ink ejecting devices are arranged.

12. The ink jet printer according to claim 9, wherein said plurality of ink ejecting devices form a length of not less than 10 mm in said one direction in which said plurality of ink ejecting devices are arranged.

13. The ink jet printer according to claim 9, wherein ink is ejected in a direction substantially perpendicular to a surface of said silicon substrate.

* * * * *

UNITED STATES PATENT AND TRADEMARK OFFICE

CERTIFICATE OF CORRECTION

PATENT NO. : 6,595,622 B2
DATED : July 22, 2003
INVENTOR(S) : R. Yamamoto

It is certified that error appears in the above-identified patent and that said Letters Patent is hereby corrected as shown below:

Column 14,
Line 24, change “ration” to -- ratio --.

Signed and Sealed this

Seventh Day of October, 2003

JAMES E. ROGAN
*Director of the United States Patent and Trademark Office*